US011346206B2

(12) United States Patent
Bowler et al.

(10) Patent No.: US 11,346,206 B2
(45) Date of Patent: May 31, 2022

(54) PROGNOSTIC HEALTH MONITORING OF DOWNHOLE TOOLS

(71) Applicant: Schlumberger Technology Corporation, Sugar Land, TX (US)

(72) Inventors: Adam Ian Bowler, Oxford (GB); Mauro Caresta, Cambridge (GB); Benjamin Peter Jeffryes, Histon (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 16/807,991

(22) Filed: Mar. 3, 2020

(65) Prior Publication Data

US 2020/0284138 A1 Sep. 10, 2020

Related U.S. Application Data

(60) Provisional application No. 62/813,484, filed on Mar. 4, 2019.

(51) Int. Cl.

| | |
|---|---|
| ***E21B 47/008*** | (2012.01) |
| ***E21B 28/00*** | (2006.01) |
| ***E21B 47/007*** | (2012.01) |

(52) U.S. Cl.

CPC ..... *E21B 47/008* (2020.05); *E21B 28/00* (2013.01); *E21B 47/007* (2020.05)

(58) Field of Classification Search

CPC . E21B 47/00; E21B 28/00; E21B 7/00; E21B 44/00; E21B 7/24; E21B 47/14; E21B 31/005; E21B 43/003

See application file for complete search history.

(56) References Cited

U.S. PATENT DOCUMENTS

| | | | | |
|---|---|---|---|---|
| 10,273,752 | B2 * | 4/2019 | Mebane, III | E21B 12/02 |
| 2009/0192731 | A1 * | 7/2009 | De Jesus | G01M 5/0025 702/42 |
| 2018/0038218 | A1 * | 2/2018 | Hay | E21B 47/024 |
| 2020/0284099 | A1 * | 9/2020 | Hassani | E21B 12/02 |

OTHER PUBLICATIONS

El-Wardany, "Tool Condition Monitoring in Drilling Using Vibration Signature Analysis". May 15, 1995, Int. J. Mach. Tools Manufacturing vol. 36, No. 6, pp. 687-711, 1996. (Year: 1995).*

(Continued)

*Primary Examiner* — Tara Schimpf

(57) ABSTRACT

Changes to the vibrational frequencies of a drill string or BHA are monitored for prognostic health monitoring purposes. When one or more orders of resonance frequencies deviate from a baseline frequency, the magnitude of the deviation, and possibly the rate of deviation, is evaluated. When the deviation exceeds a threshold value, an alert is triggered. The alert may be triggered by downhole processing of the vibration data and conveyed to an operator to allow changes in operational parameters or removal of the component from the wellbore. The alert may instead be triggered by post-run processing of stored and dumped data, that can be used to evaluate whether the tool can be re-run, or whether it should be inspected, repaired, or scrapped.

18 Claims, 7 Drawing Sheets

(56) References Cited

OTHER PUBLICATIONS

Bowler, A. et al., "Continuous High-Frequency Measurements of the Drilling Process Provide New Insights into Drilling-System Response and Transitions Between Vibration Modes", SPE Drilling & Completion, Jun. 2016, pp. 106-118.
Caresta, M. et al., "Reduction of hull radiated noise using vibroacoustic optimization of the propulsion system", Journal of Ship Research, 55(3), 2011, pp. 149-162.
Doebling, S.W. et al., "A summary review of vibration-based damage identification method", The Shock and Vibration Digest 30, 1998, 34 pages.
Halsey, G.W. et al., "Drillstring Torsional Vibrations: Comparison Between Theory and Experiment on a Full-Scale Research Drilling Rig", 61st Annual Technical Conference and Exhibition of the Society of Petroleum Engineers, New Orleans, Louisiana, USA, 1986, SPE-15564-MS, 10 pages.
Oueslati, H. et al., "New Insights into Drilling Dynamics Through High-Frequency Vibration Measurement and Modeling", SPE Annual Technical Conference and Exhibition, New Orleans, Louisiana, 2013, USA, SPE-166212-MS, 15 pages.
Pierre, C. "Mode localization and eigenvalue loci veering phenomena in disordered structures", Journal of Sound and Vibration 126, 1988, pp. 485-502.
Salawu, O.S., "Detection of structural damage through changes in frequency: a review" Engineering Structures 19, 1997, pp. 718-723.
Warren, T.M. et al., "Torsional Resonance of Drill Collars with PDC Bits in Hard Rocks", 1998 SPE Annual Technical Conference and Exhibition, New Orleans, Louisiana, USA, 1998, SPE 49204, pp. 625-637.
Zhang, Z. et al., "Continuous High Frequency Measurement Improves Understanding of High Frequency Torsional Oscillation in North America Land Drilling", SPE Annual Technical Conference and Exhibition, San Antonio, Texas, USA, S2017, PE-187173-PA, 15 pages.
Ishikawa, Y. et al., Condition Monitoring of Bridges by Vibration Analysis Using Fiber Optic Inclinometers, Engineering Asset Management, 2006, pp. 301-338.
Park, R. W., Crack Detection, Localization and Estimation of the Depth in a Turbo Rotor, KSME Internatioal Journal, 2000, 14(7), pp. 722-279.

* cited by examiner

PROGNOSTIC HEALTH MONITORING OF DOWNHOLE TOOLS

CROSS-REFERENCE TO RELATED APPLICATIONS

This application claims the benefit of, and priority to, U.S. Patent Application No. 62/813,484, filed Mar. 4, 2019, which application is expressly incorporated herein by this reference in its entirety.

BACKGROUND

In downhole systems, a drill string may be used to convey a bottomhole assembly (BHA) into a wellbore for use in analyzing, drilling, producing, remediating, or abandoning a well. During drilling, for instance, a drill string may be used to convey a drilling BHA into the wellbore. The drilling BHA includes a drill bit that is rotated to drill the formation, while drilling fluid in the wellbore is used to evacuate the cuttings to surface. The drill bit may be rotated by rotating the drill string from the surface (e.g., with a rotary table or top drive), or may be rotated using downhole equipment such as a downhole motor (e.g., positive displacement motor (PDM) or turbodrill). Of course, other components can be included in the BHA, including underreamers for expanding the wellbore, steering systems for drilling a directional well, measurement or logging-while-drilling components, and the like.

In a downhole system, fatigue cracking can occur in various downhole components. For instance, in a steering system, a collar may experience stress concentration at features such as port holes, threaded connections, and mud ports due to completing a number of cycles of alternating stress. These conditions occur due to various drilling vibrations and conditions as well as due to rotating bending in a dogleg.

Many cycles may occur before the crack initiates; however, propagation of the crack can accelerate quickly once it is formed, and lead to failure. The formation and propagation of cracks can lead to catastrophic failures resulting in twist offs, pressure loss, and the like. In some cases, the failure can result in non-productive time and even the possibility of components being lost in the well or a fishing run to retrieve a lost component. To mitigate this risk, components (e.g., collars) can be dye-penetrant tested at surface, but this is labor intensive, expensive and time consuming. Components found to have a crack can be scrapped or otherwise removed from the fleet, leading to the loss of high cost components.

SUMMARY

Embodiments of the present disclosure relate to methods for assessing the health of tool. An example method includes using one or more sensors to obtain vibration data of a tool. The vibration data may be evaluated to identify frequency modes, and thereby determine one or more baseline frequencies within the vibration data. A shift in the frequency modes can be detected relative to the one or more baseline frequencies and, when the shift exceeds a threshold, an alert is generated.

In other embodiments, a system for assessing the health of a downhole tool includes at least one vibration sensor and a processor coupled to the at least one vibration sensor. Computer executable instructions are stored on computer-readable storage media that is communicatively coupled to the at least one processor and, upon execution, the at least one processor causes the system to evaluate the health of a downhole tool. Evaluating the health includes using the at least one vibration sensor to obtain vibration data of the tool and evaluating frequency modes within the vibration data. Such evaluation also includes determining one or more baseline frequencies. A shift in the frequency modes is detected relative to the one or more baseline frequencies, and an alert is generated when the shift exceeds a threshold.

In downhole operations, a crack or other defect on a downhole tool leads to a shift in the resonance frequency of the bottomhole assembly. According to some embodiments, the vibration of a bottomhole assembly is monitored below a downhole motor, and one or more fundamental, resonance frequencies are identified. The continued vibration of the downhole tool at these one or more fundamental frequencies are monitored and shifts in the one or more fundamental frequencies are identified in real-time or post run. As shifts occur, prognostic health alerts/warnings can be generated to warn about changes to the structural integrity of the downhole tool.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

So that the recited features may be understood in detail, a more particular description, briefly summarized above, may be had by reference to one or more embodiments, some of which are illustrated in the appended drawings. It is to be noted, however, that the appended drawings are illustrative embodiments, and are, therefore, not to be considered limiting of its scope. Moreover, the drawings should be generally considered to be to scale for some embodiments, but the scale thereof is not limiting as other embodiments contemplated herein may have various scales or respective dimensions.

FIG. 3-1 is a plot of point mobility for a unit torque of the bottomhole assembly of FIG. 2.

FIG. 3-2 is a plot of the shape of one of the frequency modes of FIG. 3-1 along the length of the bottomhole assembly of FIG. 2.

DETAILED DESCRIPTION

Some embodiments of the present disclosure relate to monitoring changes in the frequency types of frequency of a component or system. For instance, example embodiments include monitoring for changes in the vibrational resonance frequency of a component or system such as a drill string, bottomhole assembly (BHA), or sub-BHA. Changes in frequencies, including vibration resonances, may be used for prognostic health monitoring of the integrity of drill string tubulars or other components, or the BHA, including downhole tools.

In accordance with some embodiments, it is theorized that when a crack forms in a tubular or other downhole component, the local stiffness decreases. The decrease in local stiffness results in a drop in the frequency of resonances of the drilling system. The larger the crack the bigger the stiffness decrease and the bigger the frequency drops. This drop in BHA resonance frequency when one of the collars or other components becomes cracked has recently been observed in numerous high frequency drilling dynamics recorded mode data sets from downhole tools. Also, it has been confirmed with modelling work, with results presented herein.

In view of the observations of resonance frequency changes as a result of crack initiate and propagation, embodiments of the present disclosure include monitoring resonance frequencies and using the measured drop in resonance frequency to identify the presence a crack in a tubular or other component, and optionally determining the size of a crack. This can be done both in real-time or using post-job data, either to advise the driller on the rig-floor when to pull out of hole and avoid a twist-off, when to reduce drilling parameters to mitigate the risk, or to aid in maintenance decisions to know if a component is good to re-run or should be scrapped without the need for dye-penetrant or other similar testing.

Figure 1:
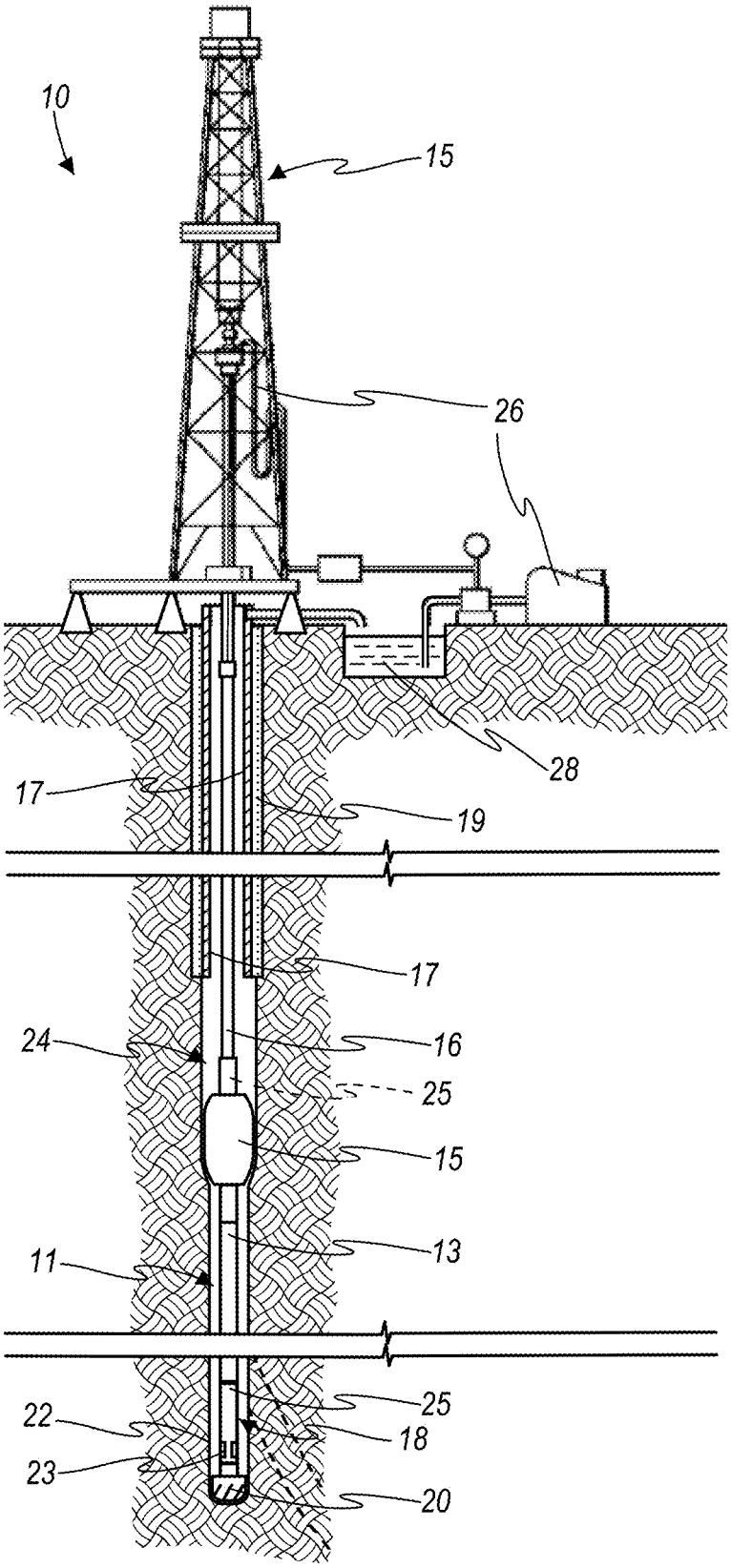
FIG. 1 is a schematic view of a downhole system, according to an embodiment.

Drilling a wellbore is illustrated by FIG. 1 which shows by way of example a drilling system 10 that includes a directional BHA 11. The directional BHA 11 includes both a drill bit 20 and a steering system 18. The BHA 11 optionally includes other components, such as an expandable underreamer 15 or telemetry system 13, which may include measurement while drilling (MWD) or logging while drilling (LWD) tools. A drill string 16 extends from a drilling rig 15 into a wellbore 22. The drill string 16 may be composed of multiple segments of drill pipe that are connected end-to-end by threaded joints, although coiled tubing may be used in some implementations. An upper part of the wellbore 22 has been lined with casing 17 and cemented as indicated at 19. The drill string 16 is connected to the BHA 11, which can include drill collars, drill string tubulars, downhole tools, or other components to connect the drill string 16 to the drill bit 20. The optional underreamer 15 has been expanded in FIG. 1 below the cased section of the wellbore 22. As the drill string 16 is rotated, the drill bit 20 extends the wellbore 22 downwards while the underreamer 15 opens the pilot hole of the wellbore 22 to a larger diameter 24.

The steering system 18 may be used to steer the BHA 11 in a desired path. The path may be a straight hole as shown in FIG. 1, or a directional wellbore (shown in dashed lines). The steering system 18 may include a rotary steerable system that operates using a so-called push-the-bit or a point-the-bit system. Push-the-bit systems include expandable pads (e.g. pads 23) that push against the wall of the wellbore 22 and push the bit in the opposite direction to steer the drill bit 20. Point-the-bit systems often have an internal drill shaft bends to point the drill bit 20 in the steering direction. Point-the-bit systems may include rotating or non-rotating housings. Other directional systems can include slide drilling systems that have a non-rotatable housing with a fixed, bent housing. In some cases, the housing of the rotary steerable or other steerable system may be called a collar.

The drilling rig is provided with a system 26 for pumping drilling fluid from a supply 28 down the drill string 16 to the reamer 18 and the drill bit 20. Some of this drilling fluid flows through passages in the drill string 16, reamer 15, steering system 18 and flows back up the annulus around the drill string 16 to the surface.

The concepts of the present disclosure may be integrated in, or associated with, any of the various components a drilling system, including downhole components such as those illustrated in FIG. 1. FIG. 1 is, however, merely illustrative and other components in a downhole system may make use of the embodiments of this disclosure. For instance, valves, stabilizers, section mills, jars, vibration tools, motors, or other components can benefit from features, techniques, and embodiments described herein. In other embodiments, features of the present disclosure may be used for monitoring condition or health of other components that are not downhole (e.g., rig equipment, generators, etc.), or non-oilfield equipment.

Regardless of the particular surface system used, the drill string 16 can rotate to transmit torque and weight-on-bit to the drill bit 20 to cut the formation. In some cases, the BHA or the steering system 18 includes a downhole motor 25 (e.g., above the pads 23), and the downhole motor 25 may rotate the drill bit 20 at a rate exceeding the rotational speed (if any) of the drill string 16. The downhole motor 25 may rotate the drill bit 20 alone, or may rotate additional components. For instance, the dashed lines illustrate an example in which the downhole motor 25 is positioned at or near the top of the BHA and is potentially used to rotate a full length of the BHA. The downhole motor 25 may include a mud motor or positive displacement motor, a turbodrill motor, or any other suitable downhole motor.

During drilling, different vibration/oscillation modes be generated. For instance, one mode of vibration may be generated above the downhole motor 25, and another mode of vibration may be generated below the downhole motor 25. In this case, the operation of the downhole motor effectively uncouples the two modes of vibration (i.e., the drill string vibration mode from the lower BHA vibration mode). This may result be the case as, for instance, the length of the drill string above the downhole motor 25 may be longer (e.g., 1-4 km) than the length of the drill string below the downhole motor 25 (e.g., 5-100 m). As a result, the drill string frequency mode may be significantly less than the lower BHA frequency mode. In some cases, the first mode may have a frequency that is fifty to five hundred times lower than the second frequency. For instance, the first frequency may be between 0.5 Hz and 3 Hz, and the second frequency may be between 100 Hz and 300 Hz. These lower BHA frequency modes may be referred to as high frequency torsional oscillations (HFTO). During different types of drilling, the HFTO may become particularly significant or evident. For instance, depending on the BHA design, the vibrations may be excited more while drilling hard rock than when drilling a softer rock. HFTO can increase risks of fatigue failure due to the high number of cycles.

Torsional resonances, mode shapes, and transfer functions can be predicted using various models. For instance, a dynamic stiffness method may be used, which models the BHA using beam theory as a combination of pipes with variable cross-sectional area. The pipes can be joined together applying the continuity conditions of torque and angular displacement at the connections, with boundary conditions that are free at both top and bottom ends to obtain a dynamic stiffness matrix (DSM). The vanishing of the determinant of the DSM gives the natural frequencies of the system. The steady-state response under harmonic torque excitation can further be calculated using a direct method in which the force is considered as part of the boundary conditions.

Torsional resonances, mode shapes, and transfer functions can be predicted using various models in addition to, or other than, a dynamic stiffness method. For instance, a finite element method may be used. In some embodiments, the dynamic stiffness method may be computationally more efficient as it can be performed without element discretization. Structural damping can also be added using a complex Young's Modulus ($E(1+j\eta)$ where E is the Young's Modulus and $\eta$ is the structural loss factor).

Figure 2:
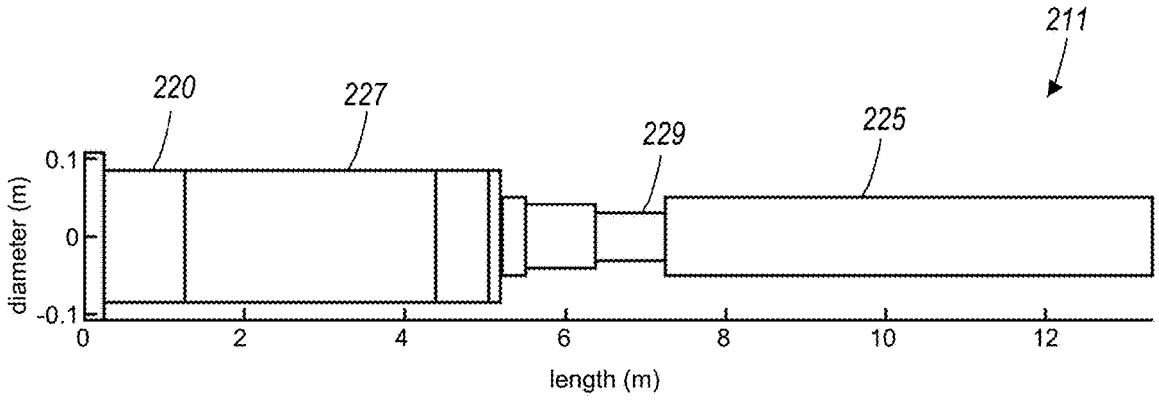
FIG. 2 is a schematic of a bottomhole assembly used for determining natural frequencies within the bottomhole assembly, according to an embodiment.

FIG. 2 is a schematic side view of a BHA 211. The BHA includes a downhole motor, and the downhole motor—or the internal rotor that is used to rotate the BHA and which rotates relative to the motor housing and the drill string—can also be considered as part of the BHA 211. The BHA 211 is an example of a BHA, but a BHA may include many additional or other components as discussed with respect to FIG. 1.

This particular embodiment depicts the BHA 211 having a diameter of 6.75 in. (17.15 cm). For illustration purposes, the x-axis (length) and y-axis (diameter) have different scale. The BHA 211 of this embodiment is made of ten cylindrical sections with different cross-sectional areas. For purposes of this example, various sections may be made of steel. The drill bit 220 is attached to the BHA 211 at the left-hand side and the narrowest section of the BHA 211 represents the drive shaft 229 coupled to the rotor of the downhole motor 225. One or more drill collars (including steering assembly collars) may be positioned between the drive shaft 229 and the drill bit 220.

Figures 1, 3:
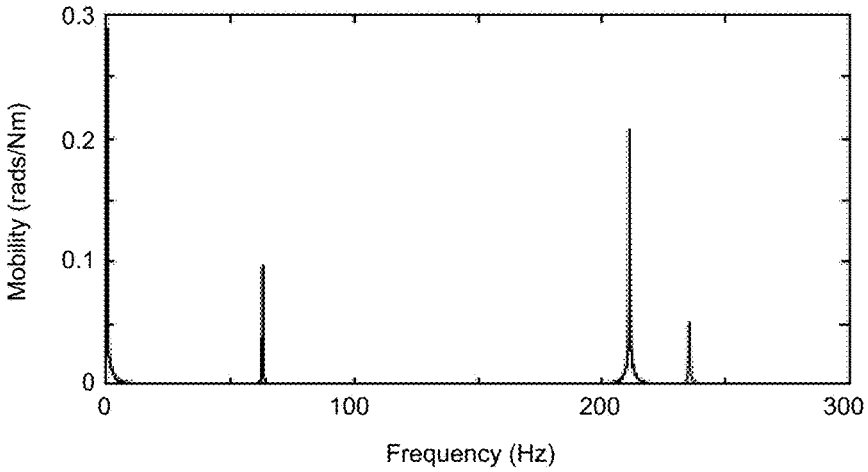
Figures 2, 3:
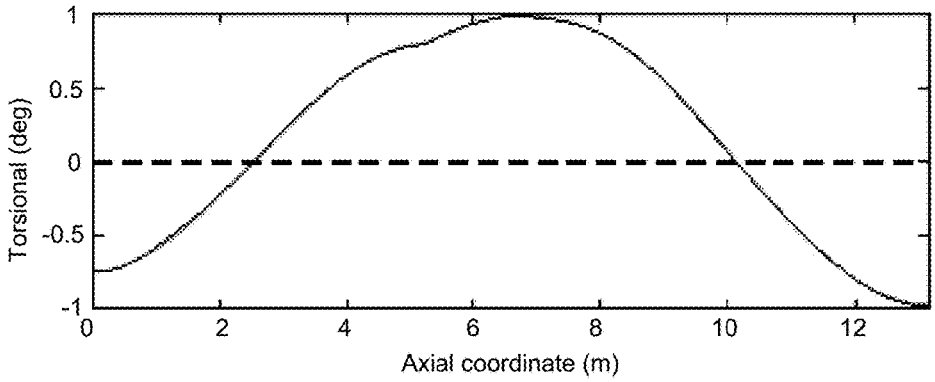

The point mobility for a unit torque impulse at the drill bit 220 can be calculated with the DSM, is shown in FIG. 3-1, and was calculated with a loss factor of $\eta=0.001$. Three natural modes are identified and illustrated as the peaks in mobility, and for this example are located at 63 Hz, 211 Hz, and 235 Hz. The mode shape can be determined, and indicate that the modes at 63 Hz and 235 Hz have an axial position that is largely localized in the rotor of the downhole motor 225. In practice, these modes do not appear in a significant amount in downhole measurements as they are damped due to the elastomer in the motor, which deviates from the steel material in the model. As a result, the main frequency shown in FIG. 3 and which is also observed during drilling is at 211 Hz, and involves the motion of the full BHA. This is illustrated in FIG. 3-2, which as shown in FIG. 3-2. In particular, FIG. 3-2 shows the mode shape at 211 Hz along the length of the BHA 211.

Figure 4:
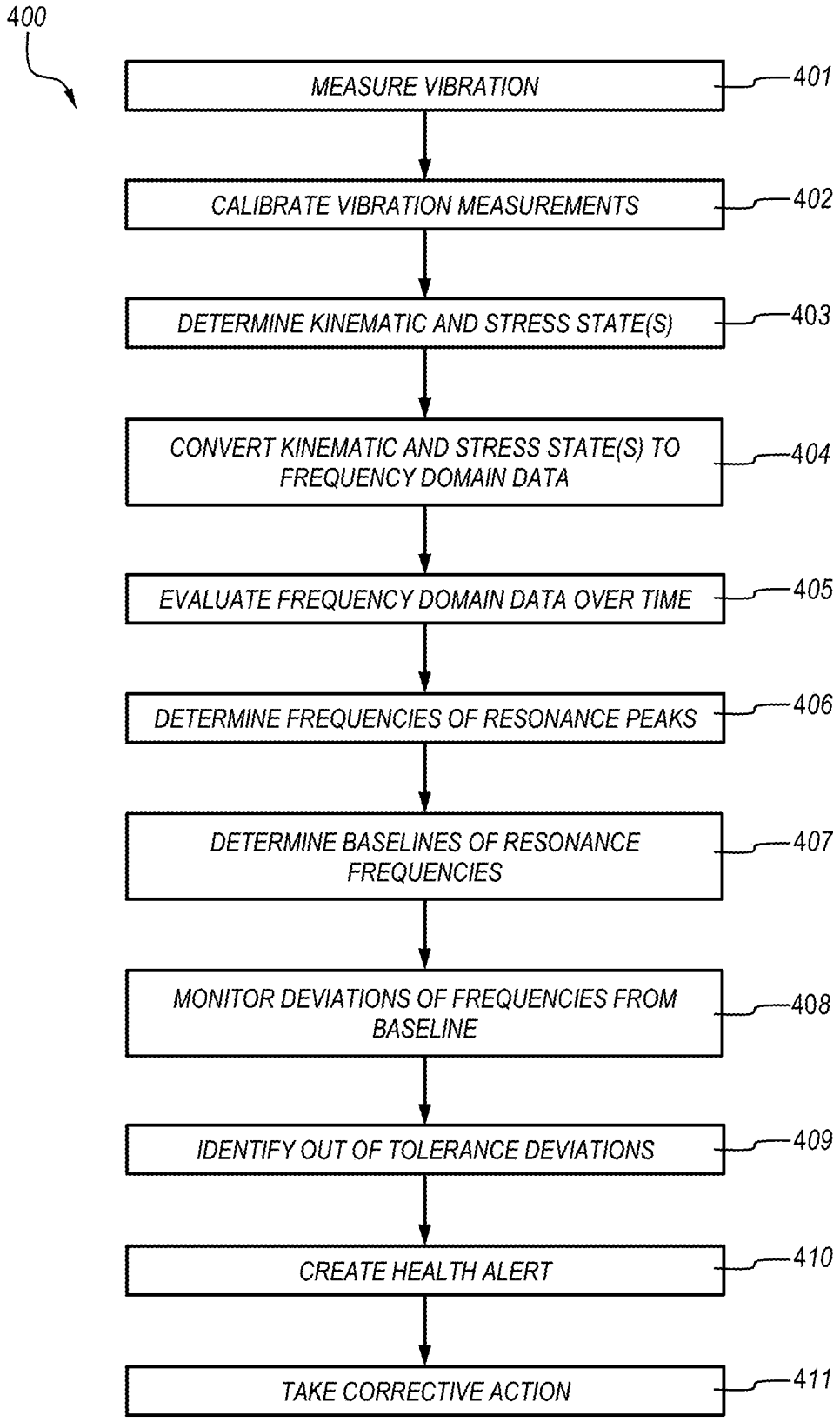
FIGS. 4 and 5 are flowcharts of example methods for assessing the health of a tool and optionally mitigation damage to the tool, in accordance with some embodiments disclosed herein.

Turning now to FIG. 4, an example method is described for use with a system and BHA such as those described in FIGS. 1 and 2. In particular, the method 400 of FIG. 4 may be used to, for example, detect cracks or defects as they occur in real-time using downhole tool sensors, processors, and hardware/firmware/software. Using such equipment, real-time messages may also be conveyed to a driller to alert the driller to the possible existence of a crack/defect so that a change in drilling parameters, or even pulling-out-of-hole may be performed in response. While described in reference to drilling, the method 400 may also be used in connection with other downhole operations, such as wireline, production, tractor conveyance, or other operations.

As shown in FIG. 4, the method 400 may include measuring vibration at 401. In some embodiments, vibration is measured at 401 using downhole sensors, such as motion or strain sensors. Such sensors may include accelerometers, gyroscopes, magnetometers, strain gauges, and the like, and may be positioned on or within a steering system (e.g., rotary steerable collar), MWD, drill bit, reamer, collar, or other component of a BHA or downhole system. Vibration measured at 401 may be measured directly, or may be indirectly determined using other direct measurements.

When the vibration is measured at 401, the vibration measurements is optionally calibrated at 402. Such calibration can occur in real-time, including using a downhole processor included in a downhole device. The downhole processor may be included in the sensor package, or may be part of another tool or component. For instance, a sensor may provide data to the MWD, which then uses a specialized processor to calibrate the data while drilling operations occur. In other embodiments, calibration may occur off-line. For instance, the sensor measuring the vibrations at 401 may be calibrated at the surface prior to initiation of a downhole procedure.

At 403, the downhole processor may use the vibration measurements or other sensor data to determine kinematic and/or stress states of a downhole component. Examples of kinematic and stress states can include angular velocity, angular acceleration, axial acceleration, torque, and the like. In some embodiments, determining the kinematic and/or stress states at 403 can also include fusing together the vibration measurements or other sensor data, and compensating for known transmissibility effects. Optionally, this is done in real-time, such as while a drilling or other downhole process is performed.

In some embodiments, the kinematic and stress states include data that is in the time domain. In method 400 of FIG. 4, this time domain kinematic and stress state information is converted to the frequency domain at 404. This may be done, for instance, by using a Fast-Fourier transform to convert the time domain data to a frequency domain spectrogram. The frequency domain spectrograms or other data can then be evaluated over time at 405. Evaluating the frequency domain data overtime may include, for instance, identifying trends in the data. In a simplified example, for instance, the downhole processor may average spectrograms over time (e.g., using a forgetting factor filter).

As will be appreciated by a person skilled in the art, there may be various components having different resonance or other identifiable frequencies within the drill string. In some embodiments, the frequency to be monitored using the method 400 is identified before the drilling or other job is performed. For instance, a model can be used to predict a resonance frequency in a range (e.g., +/−5%, +/−10%, +/−20%, +/−30%), to identify a window where frequencies can be observed. Using a smaller frequency range can allow the method 400 to be less prone to errors. For instance, using the frequencies identified above with respect to the chart of FIG. 2, the frequency mode at 211 Hz may be monitored (or a range of frequencies between 200 Hz and 220 Hz, for example, may be monitored).

With the frequency(ies) being monitored, converted to the frequency domain, and evaluated over time, a downhole or other processor can determine the frequencies of the resonance peaks at 406. This may include, for instance, using a peak finding algorithm. An example of such an algorithm may use changes in gradient or slope, that goes from a positive to negative value to identify the peak. Baselines of the resonance frequencies can also be determined (e.g., by a downhole processor) at 407. In some embodiments, the baselines of frequencies (e.g., between peaks) are determined at 407 during a run; however, in other embodiments the baselines are determined at 407 at the start of a run.

With the baselines determined at 407, a downhole processor can monitor the frequencies of peaks (i.e., identified at 406) for deviations away from the baselines at 408. The deviations can be monitored in real-time, as a downhole operation progresses, and may be compared against predetermined thresholds, by using a changepoint algorithm (e.g., Bayesian methods), or in other manners. When deviations are out of tolerance based on thresholds, changepoint algorithms, or other processes that measure deviations, the deviation can be identified at 409 (e.g., by the downhole processor). In response, a health alert can be created at 210. The health alert may include a message generated and sent by a downhole processor on a tool-to-tool communication bus warning the likelihood of a crack/defect been detected. Creating the health alert at 210 can also include using a telemetry or communication tool in the BHA that receives the warning message, and building a real-time telemetry frame that is sent to the surface. At the surface, the telemetry is de-modulated and the warning message is presented to the driller/operator on a rig-floor display, and in real-time or near real-time.

The warning that is presented may be a generic warning, or may include severity information. For instance, if a large deviation is detected at 409, the health alert at 210 may include an indication that a crack/defect has likely formed, an indication of the amount the frequency deviates from the baseline (and potentially the time over which the change occurred), and the driller (e.g., autodriller or human) can take corrective action at 411. Examples of corrective action can include reducing drilling parameters to prevent further propagation of the suspected crack, or stopping the operation and pulling out of hole. Optionally, the health alert created and transmitted at 210 may also include a recommendation or instruction based on the severity of the crack/deviation as to what action to take at 411.

Figure 5:
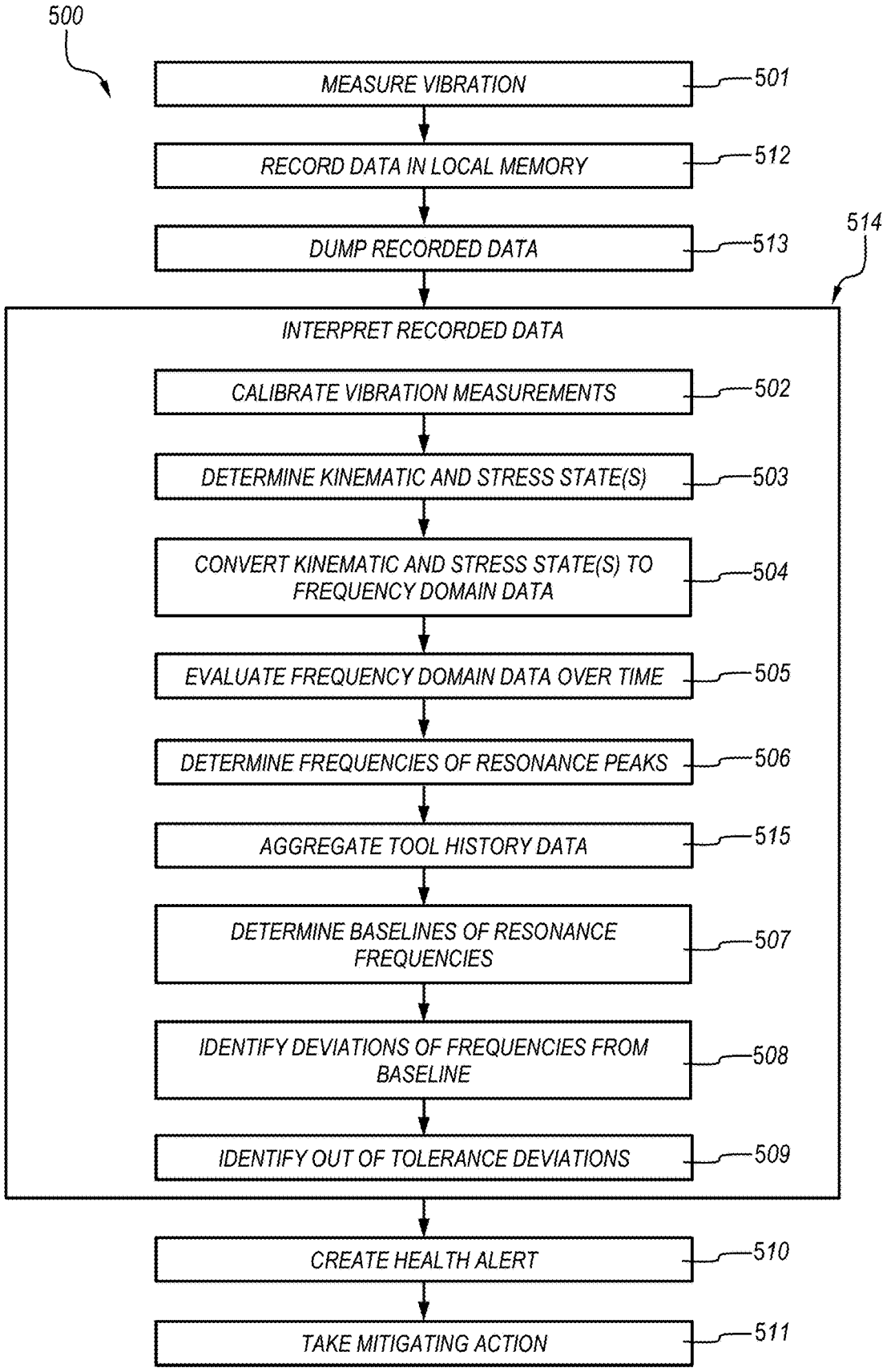

While the method 400 described with reference to FIG. 4 may be performed in real-time, during operation of a downhole tool, similar methods include elements that are performed post-run, after the operation has completed. FIG. 5, for instance, illustrates an example method 500 that may be similar to the method 400 in many respects, but includes one or more operations that are performed post-run.

For instance, the method 500 can include measuring vibration at 501. This operation may be performed while the tool is in use, and may be similar to measurements of vibration at 401 of FIG. 4. Measuring vibration at 501 can be performed using any number of accelerometers, gyroscopes, MWD, LWD, other sensors or measurement devices, or combinations of the foregoing. Also during the tool operation, measured data (e.g., sensor data or vibration data) can be recorded at 512 in local memory within a downhole tool. A downhole processor (e.g., of a sensor device, MWD, LWD, etc.) can record the data to one or more downhole persistent memory or other storage devices within the downhole tool. The operations at 501, 512 may continue at regular or other intervals. For instance, a sensor may sample vibration data at a given frequency (e.g., 1 Hz, 50 Hz, 100 Hz, 1 kHz, 2 kHz, etc.). All of the measured data may be measured/sampled, or only certain information may be measured/sampled. For instance, if a 10 Hz sensor makes ten measurements/samples per second, all of the data may be recorded, or only some of the data may be recorded. For instance, the maximum and minimum values may be recorded over a particular period (e.g., 1 second in this example), averages of all measurements of the period may be recorded, or the like. In another example, rather than measuring/sampling and recording data consistently, data may only be measured when significant events occur (e.g., shock or vibration exceeds a certain threshold).

Once the downhole operation is completed and the tool is returned to surface, the method 500 may include dumping recorded data at 513. For instance, the recorded data may be recorded to one or more files on a computing device at the surface. That data may then be interpreted at 514. One manner of interpreting the data at 514 is to perform a health management review. Accordingly, interpreting the recorded data at 514 is one example of a step for performing a health management review for a tool. Other steps for performing a health management review may take other forms. For instance, the interpretation of the recorded data at 514 is, in this example, performed post run; however, as evident by a comparison with method 400 of FIG. 4, elements of interpreting the recorded data 514 may also or instead be performed in real-time, and are not limited to performance in a post-run environment. In other steps for performing a health management review, certain acts in interpreting the data at 514 may be eliminated or be performed in a different order. For instance, another step for performing a health management review may include determining baseline frequencies at 307, identifying deviations of frequency modes from baseline frequencies at 308, and identifying deviations/shifts from the baselines at 309.

In the illustrated embodiment, interpreting the recorded data at 514 includes optional acts of calibrating vibration measurements at 502, determining kinematic and states at 503, converting kinematic and stress states to frequency domain data at 504, evaluating frequency domain data over time at 505, determining frequencies of resonance peaks at 506, determining baselines of resonance frequencies at 507, identify deviations of frequencies from the baseline at 508, and identifying out of tolerance deviations at 509. These acts may be performed in a manner similar to corresponding acts 402-409 described above with reference to FIG. 4, except that they can be performed in this instance post-run.

Optionally, interpreting the recorded data (or performing a health management review for a tool) includes aggregating tool history data at 515. In some instances, a tool is run multiple times in multiple different operations, sites, wells, or the like. For some or all of these runs, sensor/vibration data may be measured, recorded, and dumped (e.g., as at acts 501, 512, and 513). Following a run, the data for a particular run may be combined with the data from other runs. This may be done, as shown in FIG. 5 before determining baselines of resonance frequencies at 507, although it should be appreciated in view of the disclosure herein that baseline frequencies may have already been established or determined based on prior runs. Accordingly, aggregating the tool history data at 515 may occur at any stage within the method 500.

In any such embodiment, aggregated data can provide a rich set of data from which past and recent performance can be used to detect any recent changes to the data. Thus, when frequency data deviates from historical baselines, these deviations can be identified at 508 and if significant enough compared to the dynamic or static tolerances as determined at 509, the method may then create a health alert at 510. The history data may also be aggregated in a cloud-computing or neural network, which can perform machine learning algorithms to understand the cumulative damage or other changes of the tool over time in view of operations performed, repairs done, and the like.

Creating a health alert at 510 may be performed in the same general manner as creating the health alert at 410 in FIG. 4, or the health alert may be created or formatted in a different manner. For instance, when generating the health alert in a post-run environment, the health alert may be displayed or generated by the device performing the analysis at 514, without actually identifying the deviations downhole and generating an alert that is sent to the surface. Thus, the operator can visually, audibly, or otherwise perceive a warning at the same time generated or determined by a surface computing device. The health alert may include information about the type or severity of the alert, and at 511, the operator can take mitigating action. This action may include a decision to re-run the tool with different operations parameters, a decision to send it back to a base for repair, or a decision to run a different tool.

While the method 500 of FIG. 5 is described with respect to operations of a computing device at the surface (e.g., step 514 and act 510), it should also be appreciated in view of the disclosure herein that the steps or acts of the present disclosure may be performed in other devices, or systems. For instance, when the recorded data is dumped at 513, it may be ingested by a cloud computing system, a neural network, or the like. Scripts or routines running on the cloud computing system may then interpret the recorded data. This may be done in a manner similar to that shown in the step 514 for interpreting recorded data, but may be performed in any other manner that allows run specific or cumulative results of operations of a tool to be evaluated. The result of the cloud computing routines may also be a health alert at 510; however, in some embodiments, the cloud computing system may ingest and evaluate the data in a manner that allows the cloud to determine what action to take (e.g., re-run, repair, scrap), so that a separate health alert may not be provided. In some embodiments, a description of the recommended action may be provided in addition to, or alternatively from, a health alert.

Figure 6:
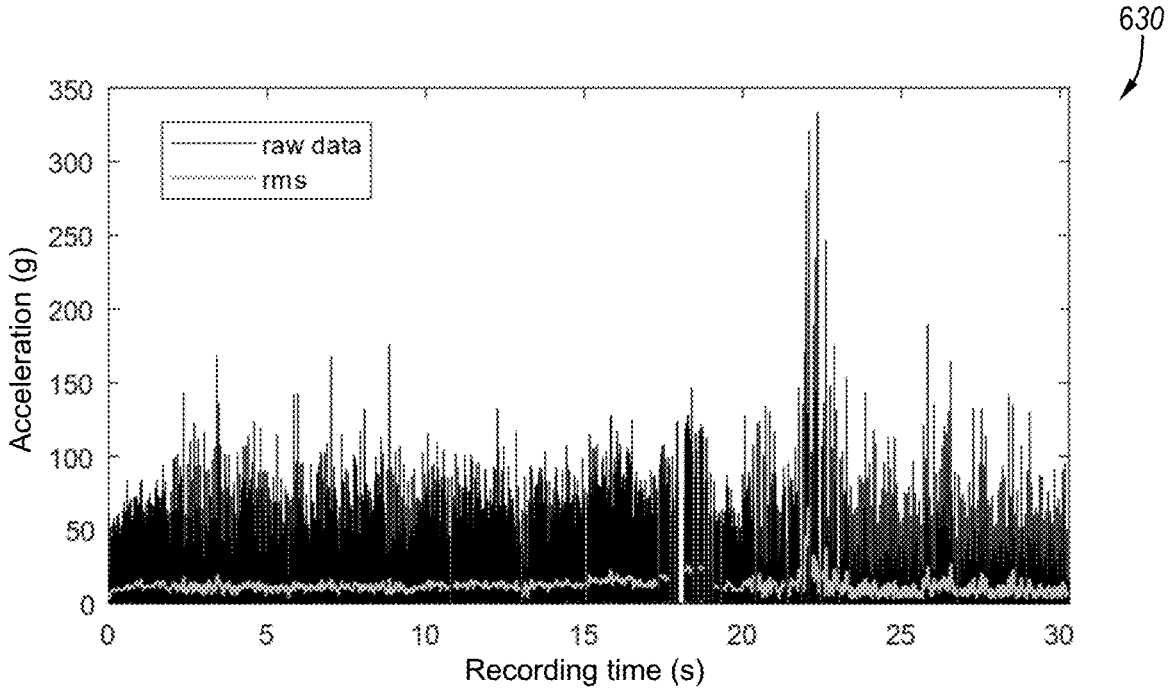
FIG. 6 is a chart showing vibration data of a downhole tool and which includes 30 seconds of drilling data, according to an embodiment.

To further illustrate the manner in which embodiments of the method 400, 500 of FIGS. 4 and 5 may be performed, specific reference will now be made to an example taken from a 6.75 in. (17.15 cm) downhole rotary steerable system run below a downhole motor, and which returned to the surface with a bias unit that had twisted off as a result of a torsional crack. During operation, the acceleration/vibration data of the tool was sampled for post-job monitoring and investigation purposes. Rather than continuously monitoring the shock/vibration events, data was recorded in bursts when the tool experienced large shock events. FIG. 6 shows a plot of 462 waveforms recorded over a day of drilling, but due to intermittent sampling based on high shock events, account for only 30 seconds of recording time. The absolute values of the acceleration and the root-mean-square (RMS) of the waveforms are plotted on the y-axis, against the recording time on the x-axis.

Figure 7:
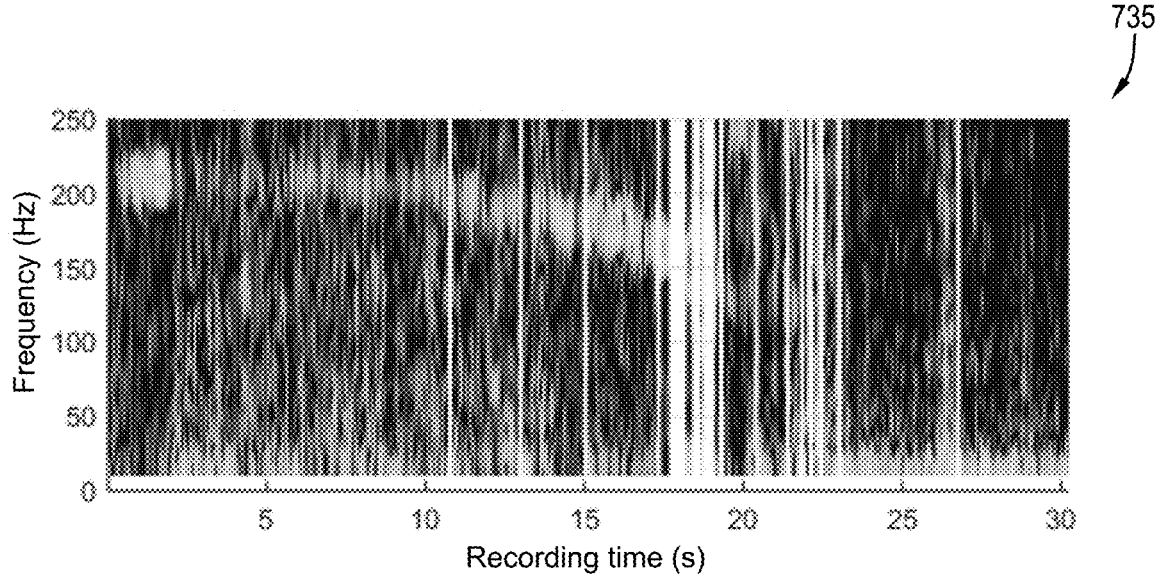
FIG. 7 is a chart showing the vibration data of FIG. 6 within a frequency domain spectrogram, according to an embodiment.

Notably, the sampled data was within the range generated by HFTO, and excluded certain lower frequency vibrations such as may be expected for drilling events such as stick slip. When the sampled HFTO data is converted to frequency domain data, the results can be plotted as a waveform as shown in FIG. 7. In particular, FIG. 7 provides a plot 735 charting the frequency along the y-axis and the recording time of the chart 630 along the x-axis. In this particular plot 735, the frequency domain data is plotted for a natural frequency mode that begins at about 211 Hz (see FIG. 3-1), although the plotted data may include or highlight other frequencies (see FIG. 10).

The chart 735 can result from converting kinematic and stress states to frequency domain data (e.g., at 404, 504 of FIGS. 4 and 5). The data is optionally normalized and colored based on energy level, which in this case uses a decibel scale. When interpreting the data, trends in the data can be observed, particularly when reviewed from left to right (increasing in recording and drilling time) and from top to bottom (decreasing in observed vibration frequency). As shown, as the recording time (and drilling time and waveform number) increases, the resonance frequency peak also remains about constant. However, after about 10 seconds of recording time, the resonance frequency peaks can be observed as reducing and shifting downward. Although the data in FIGS. 6 and 7 shows some missing data around 18 seconds, the spectrogram plot 735 illustrates that as the recording time increases (and thus the drilling time), the 211 Hz resonance dropped by about 30% down to 150 Hz.

In the context of the methods 400 and 500, the data visually depicted in the chart 735 of FIG. 7 can be processed used to determine frequencies of resonance peaks, determine baselines of resonance frequencies, monitor/identify deviations of frequencies (e.g., resonance frequency peaks), and identify out of tolerance deviations. For instance, the initial resonance frequency peak may be used alone or in combination with historical data to determine at which resonance frequencies the baselines occur (e.g., about 211 Hz in FIG. 7). As the operation continues and more data is obtained at additional events, the changes to observed frequencies can be monitored and identified. When observed resonance frequencies deviate by a sufficient amount (e.g., a relative amount such as 10%, 20%, etc. or an absolute amount such as 20 Hz, 50 Hz, etc.), a resonance frequency can be identified as being out of tolerance.

Figure 8:
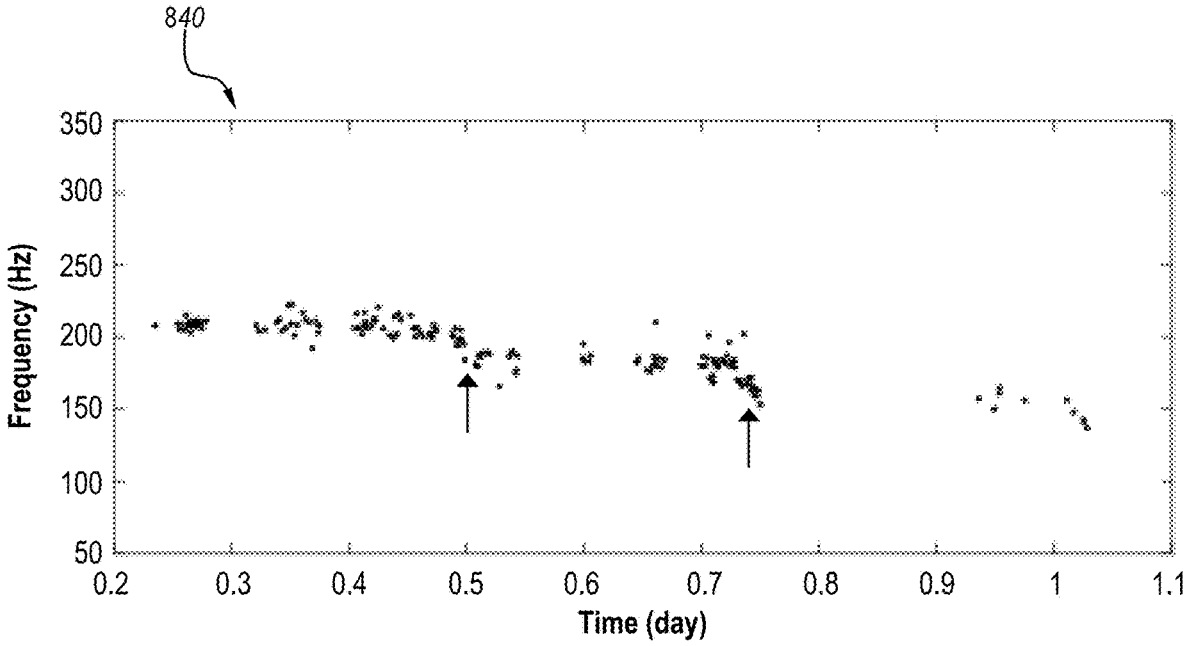
FIGS. 8 and 9 are charts of the vibration data of FIG. 6 for a first order resonance frequency, according to embodiments of the present disclosure.
Figure 9:
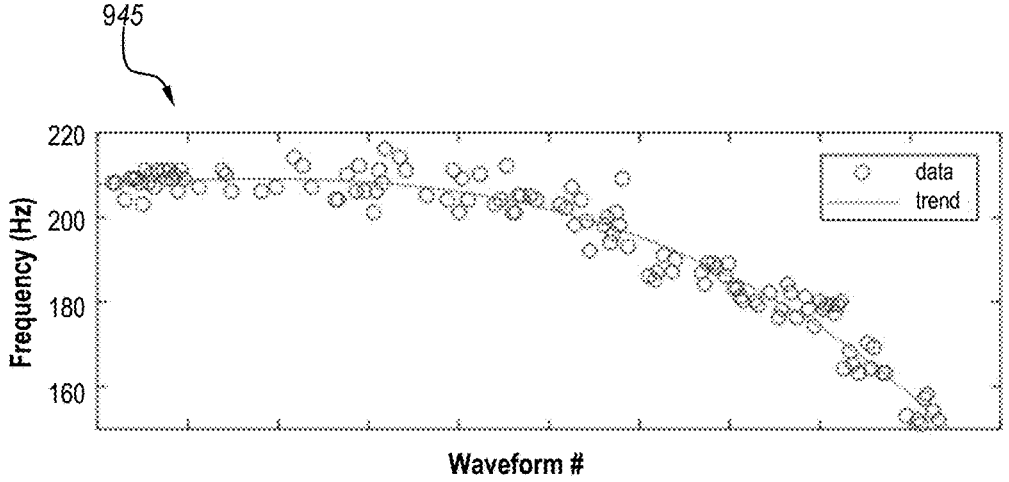

FIGS. 8 and 9 further illustrate example charts 840, 945 that can be generated using the data of FIGS. 6 and 7. FIG. 8 illustrates a chart 840 of a particular set of data (i.e., frequency data around the first harmonic or first resonance frequency of about 211 Hz in FIG. 7). The plotted data shows the observed frequency of the vibration for each event/waveform, and is plotted per absolute time, as measured in days across the x-axis. As noted above, waveforms were generated based on the occurrence of shock/vibration/acceleration events, and therefore were not purely linear with respect to time, which accounts for the time gaps between certain waveforms.

FIG. 9 is a chart 945 that is similar to chart 840 of FIG. 8 and includes effectively the same data, but plots the frequency of the waveforms with the waveform number along the x-axis. As shown in FIGS. 8 and 9, the baseline frequency initially was fairly constant; however, there were observed frequency shifts. For instance, in FIG. 8, at least two sudden decreases in frequency are observed. In FIG. 9, a trendline is also included and shows that the frequency shift can be observed as a type of cumulative damage, in which recorded events (e.g., events large enough to trigger recording), may create cumulative damage to the tool. In this case, the frequency/waveform trendline is generally cubic, but the trendline may have other characteristics for other real-world examples.

As discussed herein, changes to how a tool resonates may be indicative of changes to the condition of the tool. This may include, for instance, the formation of cracks, pitting, reductions in wall thickness, mud ringing, erosion, and the like. Consequently, with sufficiently large changes to the resonance frequencies as illustrated in FIGS. 6 to 9, health notices can be sent uphole or generated by a local computing system or cloud computing system for either real-time or post-run review and mitigation.

Additionally, the severity of a change may trigger different responses. For instance, a sudden drop in the frequency may be indicative of more significant damage (e.g., a crack). In FIG. 8, for instance, the monitored acceleration frequency began shifting at a higher rate after about 12 hours and 18 hours of drilling, as indicated by the two arrows. Sudden shifts (as determined based on absolute or relative deviations) can therefore trigger higher severity warnings so that more immediate action can be taken to change operation or pull the tool out of hole. Thus, in some embodiments, it is contemplated that not only are deviations identified, but also the severity of deviations. Depending on the severity of the deviation, different alerts can be triggered. For instance, the shift at the second arrow (e.g., around 0.75 days or 18 hours), may have been a 30% drop from the baseline between time 0.2 day and 0.5 day. This is further evident in FIG. 9 where the frequency drops 30% between 211 Hz and 150 Hz.

Additionally, while FIGS. 7 to 9 illustrate changes within a single resonance frequency shift, changes in multiple resonance frequency shifts may be monitored, and any one or more may trigger events. For instance, FIG. 3-1 illustrates that a tool may have multiple frequency modes that could be monitored. If more than one of those modes is determined to be of interest in a particular area of a BHA or other downhole tool, the multiple frequencies can be monitored.

Figure 10:
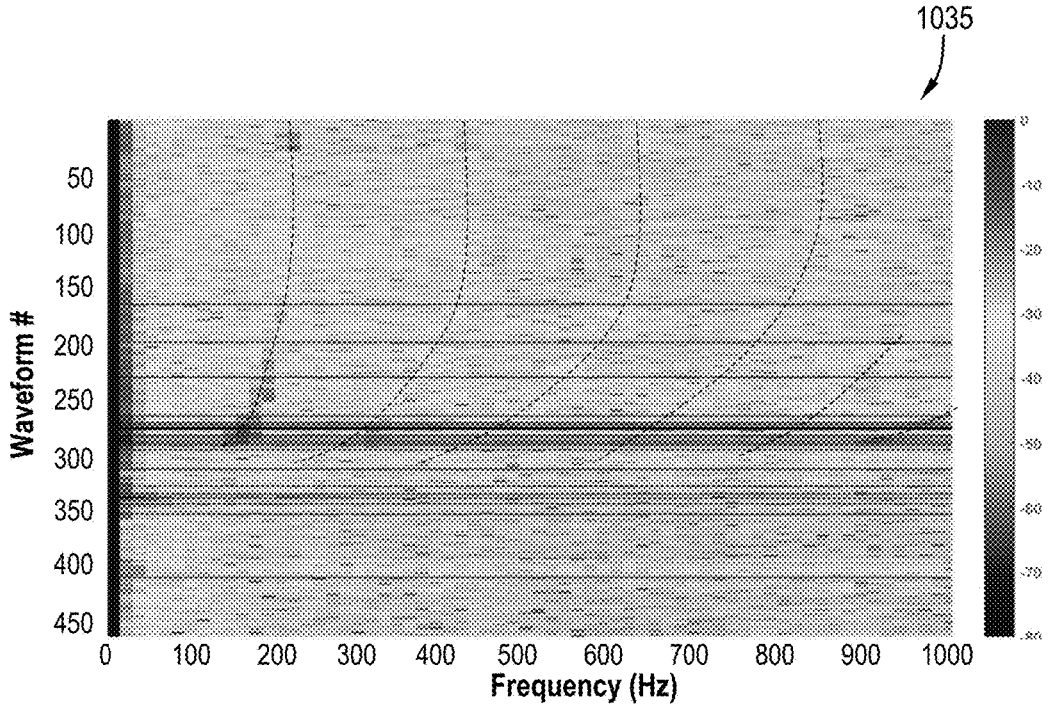
FIG. 10 is a spectrogram of frequency domain data, showing a first order resonance frequency and multiple higher order resonance frequencies, according to embodiments of the present disclosure.

In another example, FIG. 10 illustrates a chart 1035 visualizing the data of FIG. 6 over multiple frequencies. In this particular chart 1035, frequency domain data between 0 Hz and 1000 Hz is plotted across the x-axis and the waveform number (i.e., the number of a sample taken) is plotted along the y-axis. The frequency domain data may be normalized and optionally colored based on energy level, which in this case illustrate higher energy frequencies at the top of the scale (red), and lower energy frequencies at the bottom of the scale (blue).

The dashed lines generally show trends that can be observed reviewing the chart 1035 top to bottom (increasing in waveform number) and right to left (decreasing in observed vibration frequency). In this case, the leftmost line (corresponding to the leftmost frequency baseline) begins at about 211 Hz and drops about 30% by the 280th waveform.

The other trendlines represent artificial, higher harmonics of the 211 Hz frequency. As shown, these higher harmonics are initially spaced part at approximately 211 Hz intervals. As the waveform number increases (and thus as time of use increases), the resonance frequency peaks are generally constant. However, after about 265 to 290 waveforms, the resonance frequency peaks can be observed as reducing and shifting to the left. At the same time, the spacing between resonance frequency peaks also shifts, and are generally spaced apart at approximately 100-150 Hz intervals. This is merely a visual representation of the frequency data, but illustrates that the frequency domain data may be interpreted in other ways, such as by evaluating the trends of the higher-level harmonics or the spacing between harmonics. Thus, when an absolute or relative shift to one or more frequencies (possibly including higher level harmonics) including exceeds a threshold, or when an absolute or relative spacing between harmonics shifts, an action as disclosed herein can be taken. In some embodiments, the relative percent change may be about the same across harmonics, so to allow for more efficient analysis and monitoring, a limited number of harmonics (e.g., 1, 2, 3, 4, 5, etc.) may be monitored so as to save processing and improve response time.

Consistent with the above examples, a model was generated to show the changes in fundamental and harmonic/resonance frequencies a BHA. The shift in these fundamental frequencies in a downhole tool can be explained by the presence of a progressively opening crack. As the crack begins and propagates, the stiffness of the BHA locally reduces. A crack can be modeled as a localized spring with a variable stiffness (K), which is related to the crack size. A large value for stiffness can be used to represent a rigid connection, while on the other hand K=0 indicates that two parts are completely disconnected. A torsional model described herein can be modified by adding a localized spring at the location of a crack.

Figure 11:
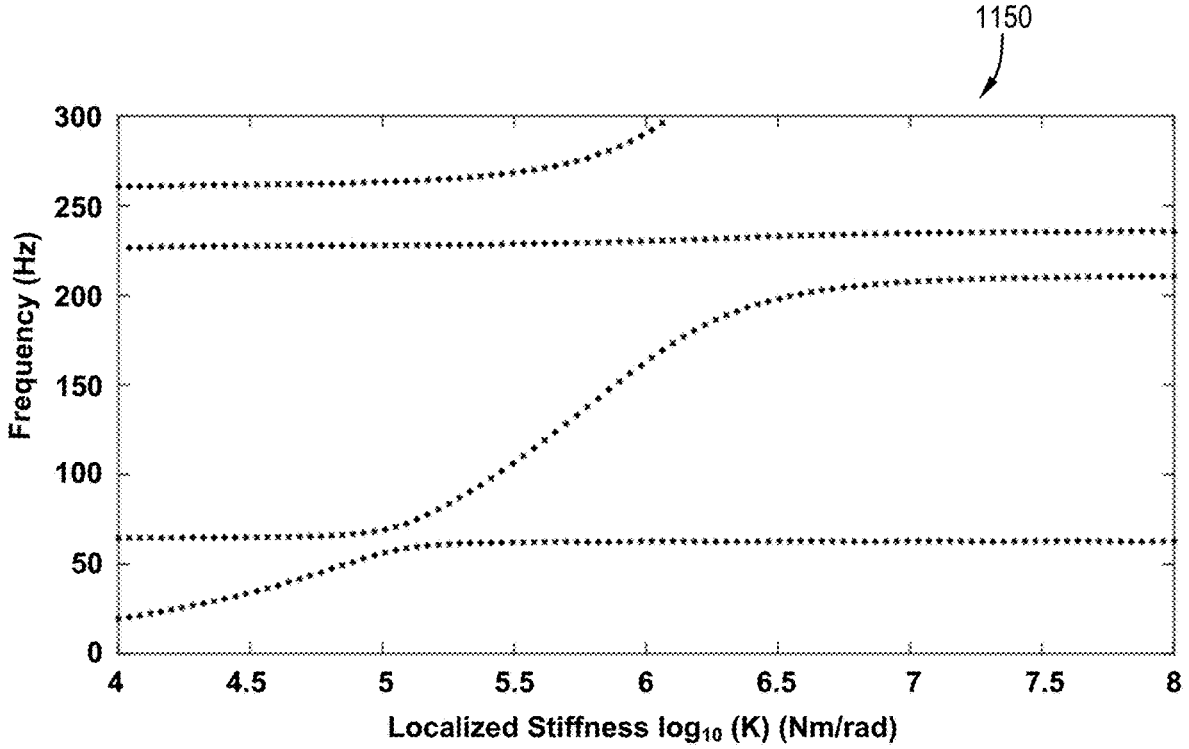
FIG. 11 is a graph of frequency response in view of localized stiffness, according to an embodiment.

The model of a BHA such as that shown in FIG. 2 and discussed elsewhere herein may be used and incorporate frequency domain data that is not limited by wavelength or element size, and can further take into account any cross-section changes in the BHA. The graph 1150 in FIG. 11 shows the shift of natural frequency modes in a BHA as a function of the variable stiffness. The x-axis is the localized stiffness at a location of a crack or other defect, and the y-axis is the natural frequency mode.

Graph 1150 shows that as the value of K decreases (and the crack size increases), a frequency with a baseline at 211 Hz shifts toward a lower frequency. For the frequency to shift down to 150 Hz as shown in the example described above, the stiffness drops around two orders of magnitude (e.g., around 50% of the original value of K). This stiffness decrease can seem quite large, but as stiffness is in Gigajoules (GJ) and the section modulus is in Joules (J), it is proportional to $r^4$. Also of interest is that as K decreases and approaches $10^5$ Nm/rad, the mode appears to flatten and approach the value of a first mode at 63 Hz (see FIG. 3-1).

These observations have real-world implications for detection of cracks and damage occurring in real-time or detecting damage post run. In particular, field data and analysis can be used for prognostic health monitoring by tracking the value of the dominant resonance of the BHA, to detect in real-time the structural integrity of the tools. As shown from the field example, the vibrational frequency shift was a clear indication of an opening crack, and knowledge of that in real-time could have present tools from being lost in hole. By using accelerometer or other sensor data, a downhole processor can evaluate frequency shift and send a flag to the surface in a telemetry signal to alert the driller of any change (or of repeated changes) larger than a predefined noise threshold. Interestingly, the exact relationship between the stiffness K and the crack size is not necessary for monitoring purposes.

Thus, as changes in stiffness result in potentially large drops in resonance frequency, a driller may be alerted and can determine that it is worthwhile to pull a tool out of the hole or do a thorough inspection, even where the tool has a relatively small percentage change in observed vibration frequencies. Waiting for a large change in frequency may create a higher risk as failure may occur within a short burst of high stress cycles, and latency of the measurement in real-time (e.g., using telemetry), may mean the surface personnel may not have time to react as damage accelerates.

While embodiments of the present disclosure are described with reference to spectrograms and plots, other embodiments may use a fast Fourier transform (FFT) of the spectrum to determine the separation of harmonics of resonance frequency peaks, or other methods for producing data (e.g., frequency domain data) from which a harmonics, baselines, and frequency shifts can be identified. The data may be evaluated against absolute values, static or dynamic thresholds, or the like. Further, while plots or charts are shown herein, these charts are illustrative to provide one skilled in the art with an understanding of methods and systems of the present disclosure. While similar plots or charts may be produced within disclosed methods, other embodiments may evaluate data without producing or evaluating such a plot or chart. For instance, downhole systems may interpret vibration data using a downhole processor, without visualizing the data.

In accordance with some embodiments, structural models of a drilling tool are identified, and can show a relationship between the natural frequency and the localized crack stiffness. By monitoring this frequency shift, costly and potentially catastrophic failures can be avoided. For instance, the frequency shift can be monitored by providing wired drill pipe or other telemetry tools that provide real-time or near real-time communication to the surface to allow for interpretation, visualization, or reporting at the surface. In other cases, downhole closed-loop monitoring may be provided in an MWD, LWD, steering system, or other tool to detect frequency shift. Upon detecting a shift exceeding a static or dynamic threshold, downhole actions may be taken to mitigate the risk, or communication may be provided to the surface to alert the operator of potential risks.

Such modeling and monitoring provide an improvement to existing downhole and surface systems. For instance, rate-of-penetration (ROP) has increased in drilling operations, in line with the aim of reducing costs and reaching reservoirs in shorter times. This is particularly the case for long, horizontal wells, which can now be at depths of 10,000 feet or more. These increases can be attributed to some extent to the greater capabilities of rig systems that can push larger amounts of energy into the drilling system. With increased power, there can also be an increased stress on the downhole tools, leading to increased stress-induced (and fatigue) failures at the weakest points of the BHA. By monitoring the vibration measurements as part of a prognostic health monitoring system, the structural integrity of tools can be tracked, and crack propagation can be identified as, for instance, fundamental downhole frequency modes drop (e.g., up to 10%, 20%, 30%, or more).

In some embodiments, the methods of the present disclosure may be executed by a computing system. For instance, a computing system may include a computer or computer system that is an individual computer system or an arrangement of distributed computer systems. The computer system can include one or more analysis modules that are configured to perform various tasks according to some embodiments, such as one or more methods disclosed herein. Example modules or computing systems may be in the form of special-purpose downhole tools (e.g., sensor packages), or surface equipment. To perform these various tasks, the analysis module executes independently, or in coordination with, one or more processors, which are connected to one or more computer-readable media. The processors are optionally connected to a network interface to allow the computer system to communicate over a data network with one or more additional computer systems and/or cloud computing systems that may or may not share the same architecture, and may be located in different physical locations. For instance, one computer system may be located in downhole equipment, another may be a rig surface, another may be in a repair facility, another may be in a cloud-computing facility or data center, and any may be located in varying countries on different continents.

A processor may include a microprocessor, microcontroller, processor module or subsystem, programmable integrated circuit, programmable gate array, or another control or computing device. Additionally, while computer-readable media may be within a computer system, in some embodiments, computer-readable media may be distributed within and/or across multiple internal and/or external enclosures of a computing system and/or additional computing systems. The computer-readable media may be implemented as one or more computer-readable or machine-readable storage media, transmission media, or a combination of storage and transmission media.

As used herein, "storage media", "computer-readable storage media," and the like refer to physical media that stores software instructions in the form of computer-readable program code that allows performance of embodiments of the present disclosure. "Transmission media", "computer-readable transmission media," and the like refer to non-physical media which carry software instructions in the form of computer-readable program code that allows performance of embodiments of the present disclosure. Thus, by way of example, and not limitation, embodiments of the present disclosure can include at least two distinctly different kinds of computer-readable media, namely storage media and/or transmission media. Combinations of storage media and transmission media should be included within the scope of computer-readable media.

To further illustrate the distinct nature of storage media and transmission media, storage media may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLURAY® disks, or other types of optical storage, or solid state drives, or other types of storage devices.

Transmission media may conversely include communications networks or other data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can therefore include a communication network and/or data links, carrier waves, wireless signals, and the like, which can be used to carry desired program, code means, or instructions.

Note that the instructions discussed above may be provided on one computer-readable or machine-readable medium, or may be provided on multiple computer-readable or machine-readable media distributed in a large system having possibly plural nodes. Such computer-readable or machine-readable medium or media is (are) considered to be part of an article (or article of manufacture). An article or article of manufacture may refer to any manufactured single component or multiple components. The computer-readable medium or media may be located either in the machine running the machine-readable instructions, or located at a remote site from which machine-readable instructions may be downloaded over a network for execution. Further, where transmission media is used, upon reaching various computing system components, program code in the form of computer-executable instructions or data structures can be transferred automatically or manually from transmission media to storage media (or vice versa). For example, computer-executable instructions or data structures received over a network or data link can be buffered in memory-type storage media (e.g., RAM) within a network interface module (NIC), and then eventually transferred to computer system RAM and/or to less volatile storage media (e.g., a hard drive) at a computer system. Thus, it should be understood that storage media can be included in computer system components that also (or even primarily) utilize transmission media.

It should be appreciated that described computing systems are merely examples of computing systems, and that a computing system may have more or fewer components than described, may combine additional components not described, or may have a different configuration or arrangement of the components. The various components of a computing system may be implemented in hardware, software, or a combination of both hardware and software, including one or more signal processing and/or application specific integrated circuits.

Further, the steps in the processing methods described herein may be implemented by running one or more functional modules in information processing apparatus such as general-purpose processors or application specific chips, such as ASICs, FPGAs, PLDs, or other appropriate devices. These modules, combinations of these modules, and/or their combination with general hardware are included within the scope of the present disclosure.

Computational interpretations, models, and/or other interpretation aids may be refined in an iterative fashion; this concept is applicable to the methods discussed herein. This may include use of feedback loops executed on an algorithmic basis, such as at a computing device, and/or through manual control by a user who may make determinations regarding whether a given event, action, template, model, or set of charts has become sufficiently accurate for the evaluation of the frequency data under consideration.

The terms "couple," "coupled," "connect," "connection," "connected," "in connection with," and "connecting" refer to "in direct connection with" or "in connection with via one or more intermediate elements or members." In the claims, means-plus-function clauses are intended to cover the structures described herein as performing the recited function and not merely structural equivalents, but also equivalent structures. It is the express intention of the applicant not to invoke functional claiming for any limitations of any of the claims herein, except for those in which the claim expressly uses the words "means for" or "step for" together with an associated function.

Although a few example embodiments have been described in detail above, those skilled in the art will readily appreciate that many modifications are possible in the example embodiments without materially departing from the scope of the present disclosure. Accordingly, any such modifications are intended to be included within the scope of this disclosure.

The invention claimed is:

1. A method for assessing health of a downhole tool, comprising:

using one or more sensors, obtaining vibration data of the downhole tool;

evaluating frequency modes within the vibration data and thereby determining one or more baseline frequencies;

detecting a shift in the frequency modes relative to the one or more baseline frequencies, wherein detecting the shift in the frequency modes relative to the one or more baseline frequencies includes determining that at least one frequency mode is decreasing relative to the one or more baseline frequencies; and when the shift exceeds a threshold, generating an alert.

2. The method of claim 1, wherein evaluating frequency modes, detecting the shift, and generating the alert are performed real-time during operation of the downhole tool.

3. The method of claim 2, further comprising stopping operation of the downhole tool, and wherein evaluating frequency modes, detecting the shift, and generating the alert are performed after stopping operation of the downhole tool.

4. The method of claim 1, further comprising converting the vibration data to frequency domain data, and wherein evaluating frequency modes within the vibration data includes evaluating frequencies in the frequency domain data.

5. The method of claim 1, wherein the shift includes a first shift in a first frequency mode and a second shift in a second frequency mode, the first frequency mode being higher than the second frequency mode, and the first shift having a larger magnitude than the second shift.

6. The method of claim 1, wherein generating the alert includes choosing an alert based on a magnitude of the shift.

7. The method of claim 1, wherein the threshold is at least 5% of the one or more baseline frequencies.

8. The method of claim 1, further comprising:

storing the vibration data; and dumping the stored vibration data to at least one of local or cloud storage.

9. The method of claim 1, wherein the one or more sensors include at least one accelerometer, and the vibration data includes at least one of radial or torsional vibration.

10. A method for assessing health of a downhole tool, comprising:

using one or more sensors, obtaining vibration data of the downhole tool;

evaluating frequency modes within the vibration data and thereby determining one or more baseline frequencies, wherein determining the one or more baseline frequencies includes using historical vibration data of the downhole tool;

detecting a shift in the frequency modes relative to the one or more baseline frequencies; and when the shift exceeds a threshold, generating an alert or taking a corrective or mitigating action.

11. The method of claim 1, wherein detecting the shift in the frequency modes includes determining a separation between at least two of the frequency modes has changed.

12. The method of claim 1, wherein detecting the shift in the frequency modes includes determining a shift in a first frequency mode exceeds the threshold while a shift in a second frequency mode that is lower than the first frequency mode does not exceed the threshold.

13. The method of claim 1, wherein detecting the shift in the frequency modes includes limiting evaluation to a discrete number of the frequency modes.

14. A system for assessing health of a downhole tool, comprising:

at least one vibration sensor;

at least one processor coupled to the at least one vibration sensor; and computer-readable storage media communicatively coupled to the at least one processor and which store computer-executable instructions that, when executed by the at least one processor, cause the system to perform the method of claim 1.

15. The system of claim 14, further comprising a downhole drilling system including:

a drill bit;

a steering assembly coupled to the drill bit; and a downhole motor coupled to the steering assembly, with the steering assembly between the drill bit and the downhole motor, the at least one vibration sensor obtaining vibration data of the downhole drilling system at one or more locations at or below the downhole motor.

16. The system of claim 14, wherein the computer-executable instructions are further configured, when executed by the at least one processor, to obtain vibration data of the downhole tool, evaluate the frequency modes, detect the shift, and generate the alert while the downhole tool is downhole, wherein generating the alert includes transmitting the alert to surface.

17. A method for assessing health of a downhole tool, comprising:

using one or more sensors, obtaining vibration data of the downhole tool, wherein the downhole tool is operated in the presence of a drilling fluid within the downhole tool;

evaluating frequency modes in a frequency domain within the vibration data and thereby determining one or more fundamental resonance frequencies that identify one or more baseline frequencies;

detecting a shift in the frequency modes relative to the one or more baseline frequencies, the shift including a sloped change to the one or more fundamental resonance frequencies of the downhole tool; and when the change to the one or more fundamental resonance frequencies exceeds a threshold, generating an alert.

18. The method of claim 1, further comprising:

taking a corrective or mitigating action based on the alert.

* * * * *